United States Patent [19]

Thomas et al.

[11] Patent Number: 4,749,096

[45] Date of Patent: Jun. 7, 1988

[54] TAMPER-EVIDENT CONTAINER COVER

[75] Inventors: Anthony J. A. Thomas, Leighton Buzzard; Charles G. Tilbrook, Dunstable, both of England

[73] Assignee: Metal Closures Group PLC, England

[21] Appl. No.: 926,515

[22] Filed: Nov. 4, 1986

[30] Foreign Application Priority Data

Nov. 8, 1985 [GB] United Kingdom ..... 8527598

[51] Int. Cl.[4] ..... B65D 41/42

[52] U.S. Cl. ..... 215/256; 53/88; 215/277; 215/324

[58] Field of Search ..... 215/277, 326, 324, 256; 53/488, 487, 449

[56] References Cited

U.S. PATENT DOCUMENTS

| | | | |
|---|---|---|---|
| 1,982,567 | 11/1934 | Blanchard | 215/256 |
| 3,109,547 | 11/1963 | Wood | 215/256 |
| 3,191,790 | 6/1965 | Coven et al. | 215/277 X |
| 3,961,719 | 6/1976 | Pierlot et al. | 215/277 |
| 4,552,278 | 11/1985 | Romanauskus | 215/277 |

FOREIGN PATENT DOCUMENTS

| | | | |
|---|---|---|---|
| 327220 | 3/1958 | Switzerland | 215/277 |

*Primary Examiner*—Donald F. Norton
*Attorney, Agent, or Firm*—Roland T. Bryan

[57] ABSTRACT

A capsule 11 for enclosing a neck portion of a container 17 equipped with a bung, cork, screw-cap or other closure 18 is formed from a crimp-shaped capsule blank. The blank has a top 12 and a depending skirt 13 and is made by impact-extruding a strip of aluminum. The skirt is compressed inwardly into close contact with the neck portion of the container and the exposed laterally-facing surfaces of the closure 18. The skirt of the blank may have an increasing diameter in a direction away from the top and may have formed thereon prior to application of the blank to the container circumferentially-extending lines of weakness 14 and a tear-tab for facilitating removal of the capsule.

12 Claims, 1 Drawing Sheet

TAMPER-EVIDENT CONTAINER COVER

Figure 1:
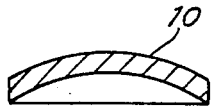

This invention relates to capsules and more particularly to capsules of the kind used to cover the upper parts of the neck of a container the mouth of which has been closed by a cork, screw-cap, bung or other form of closure, and the exposed parts of the closure to provide a tamper-evident cover for the closure.

According to this invention there is provided a container having a neck the mouth of which is closed by a bung, cork, screw-cap or other form of closure, the upper portions of the neck of the container and the exposed portion of the applied closure being covered by a capsule formed from an aluminium impact extrusion of inverted cup shape, the sides of the extrusion being deformed inwardly into close contact with the surface of the neck of the container and/or any exposed laterally-facing surface of the capsule, whereby the capsule is retained on the closure and provides a tamper-evident cover for the closure.

The invention also provides a method of applying a capsule to the neck of a container equipped with a closure, including the steps of placing over the exposed portion of the closure and the portions of the neck adjacent thereto a capsule blank comprising an aluminium impact extrusion of inverted cup shape, and deforming the sides of the cup inward into gripping contact with the neck of the bottle and/or any exposed laterally-facing surface of the closure, whereby the capsule is retained on the container and provides a tamper-evident cover for the closure.

The invention further provides a capsule blank for application about the neck portion of a container and over a bung, cork, a screw-cap or other form of closure fitted on said neck portion to form a tamper-evident cover for the closure, which capsule blank comprises aluminium impact extrusion of inverted cup shape forming a top and a depending skirt which is capable of being crimped inwardly into close contact with said neck portion.

The top of the blank may be made thicker than the skirt. The blank may for example have a top with a thickness in the range of 0.51 mm to 0.64 mm (0.020" to 0.025") and a skirt with a thickness of substantially 0.18 mm (0.007"). The blanks may be arranged to be capable of nesting one within the other, for use in automatic machinery, by subjecting the blank, prior to placing of the blank of the container, to a pressing or other forming operation to make the side wall conically inclined and/or to increase the diameter of the portions of the side wall furthest from the top to form a step.

In a preferred method according to the invention the aluminium slug from which the blank is impact extruded is stamped out of a strip of 97% pure aluminium which has been formed by continuous casting and has then in successive steps been hot rolled, cold rolled, annealed, and cold rolled again. After the stamping operation the slugs are annealed, and the capsule blank is annealed after the impact extrusion process and again after a forming operation to impart a conical inclination and/or a stepped formation to the side wall to enable the blanks to be nested. The blank is then placed on the container to be swaged into close conformity with the upper portions of the neck and any exposed laterally-facing surfaces of the closure. The slug is conveniently in the form of a circular disc, and disc thicknesses of 1.5 to 3 mm are found to provide the appropriate amounts of material to form the blanks for a substantial range of sizes of finished capsule. If desired the slug may have a central aperture, to form an inverted cup-shaped blank with a central hole in its top wall, where a capsule of that form is required. Alternatively, a plurality of smaller holes, e.g. for cork-venting purposes, may be formed in the top wall of the capsule blank in a separate operation. Similarly the blank may be operated on, prior to its application to the containers, to emboss the top wall of the blank and/or to form tear-tabs and score-lines or other lines of weakness to facilitate legitimate removal of the capsule from the container.

Figure 2:
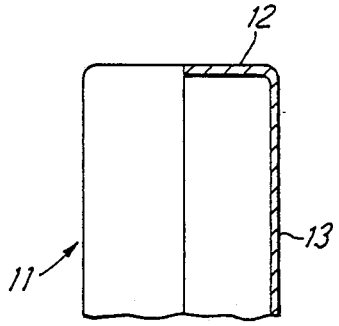
Figure 3:
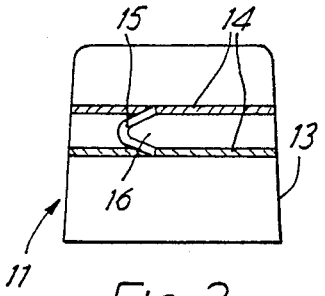
Figure 4:
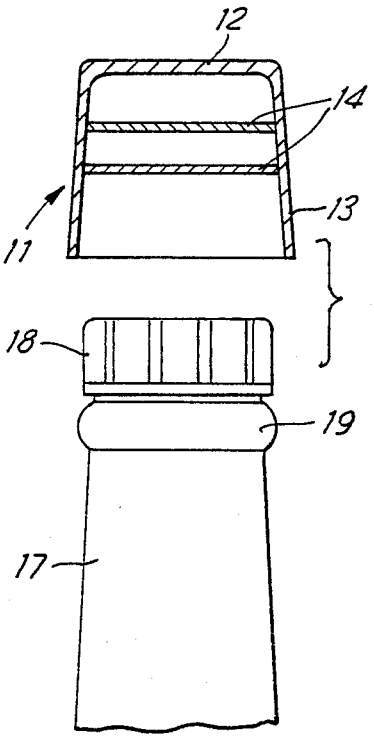
Figure 5:
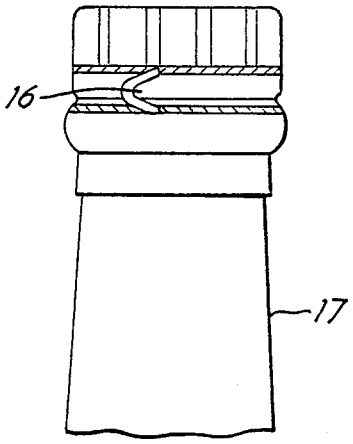
Figure 6:
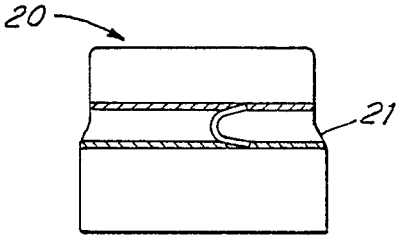

The invention will now be further described with reference by way of example to the accompanying diagrammatic drawings in which:

FIG. 1 is a sectional view of an aluminium slug for forming a capsule blank according to the invention, FIGS. 2 and 3 respectively illustrate further steps in the manufacture of the capsule blank, and FIGS. 4 and 5 show the blank and the closured container respectively before and after the application of the blank, and FIG. 6 shows an alternative form of the capsule blank.

FIG. 1 shows a domed circular aluminium slug 10 stamped out of strip material and subsequently annealed as described above. FIG. 2 shows the blank 11, partly in section, which is made from the slug in an impact extrusion process. The slug and the impact extrusion equipment are selected to give in this instance a blank whose top 12 has a thickness in the range 0.51 to 0.64 mm (0.020" to 0.025") and whose skirt 13 has a lesser thickness, 0.18 mm (0.007") in this instance. This thickness of the top is particularly suitable to have matter such as a symbol embossed thereon before application of the blank to the closured container. The blank shown in FIG. 2 subsequently has its skirt trimmed to a desired length and expanded into slightly conical form to permit nesting of the blanks. In addition, two parallel circumferentially extending lines of weakening 14 are formed in the skirt and a V-shaped cut 15 is made in the part of the skirt between these lines, so as to form a pull-tab 16 facilitating removal of the capsule. The resulting capsule blank is shown in FIG. 3.

FIG. 4 shows the blank 11 and the container to which it is to be applied. The container in this instance is a bottle 17 with a screw-cap 18. Just below the bottom edge of the cap the neck is formed with an annular bead 19. The blank is placed over the closure and the adjoining parts of the neck of the bottle so as to cover the cap and the bead 19 is then deformed inward into close contact with the bottle and laterally facing surfaces of the cap as shown in FIG. 5 by rollers driven about the central axis of the neck of the container or by inward compression by a rubber or plastics sleeve encircling the blank or by any other convenient means.

FIG. 6 shows an alternative form of the blank 20 prior to application to the container. In this case the side wall is stepped as at 21 to enable like blanks to be nested for stacking purposes. After application to the container and after subsequent deformation of the blank inwardly into close contact with the container the arrangement has a similar appearance to that shown in FIG. 5.

We claim:

1. A container having a neck, a mouth at the upper end of the neck, a closure sealing the mouth, and a capsule covering at least part of the closure and portions of the neck adajcent the closure and providing a tamper-evident cover for the closure, the closure being secured to the neck independently of the capsule, which capsule is an impact extrusion formed from substantially pure aluminum and has a top and a depending side wall, said side wall being deformed inwardly into close contact with said closure and said adjacent portions of the neck.

2. A container having a neck, a mouth at the upper end of the neck, and a radially outwardly projecting bead on the neck below said mouth, a closure sealing the mouth, and a capsule covering at least part of the closure and portions of the neck adjacent the closure and providing a tamper-evident cover for the closure, the closure being secured to the neck independently of the capsule, which capsule is an impact extrusion formed from substantially pure aluminum and has a top and a depending side wall, said side wall being deformed inwardly into close contact with said closure and said adjacent portions of the neck including said bead.

3. A container having a neck, a mouth at the upper end of the neck, a closure sealing the mouth, and a capsule covering at least part of the closure and portions of the neck adjacent the closure and providing a tamper-evident cover for the closure, the closure being secured to the neck independently of the capsule, which capsule is an impact extrusion formed from substantially pure aluminum and has a top and a depending side wall, said side wall having therein two parallel circumferentially-extending lines of weakening and a pull tab formed between said lines of weakening, and said side wall being deformed inwardly into close contact with said closure and said adjacent portions of the neck.

4. A container having a neck, a mouth at the upper end of the neck, a closure sealing the mouth of the container and having at least a part thereof disposed outside the mouth of the container, the neck having a radially outwardly projecting annular bead below said part of the container, and a capsule covering at least part of the closure and portions of the neck adjacent the closure and providing a tamper-evident cover for the closure, the closure being secured to the neck independently of the capsule, which capsule is an impact extrusion formed from substantially pure aluminum and has a top and a depending side wall, said side wall being deformed inwardly into close contact with said closure and said adjacent portions of the neck, said side wall having therein two parallel circumferentially-extending lines of weakening and a pull tab formed between said lines of weakening, and said side wall being deformed inwardly into close contact with said closure and said adjacent portions of the neck including said bead.

5. A method of applying a capsule to the neck of a container equipped with a closure which is secured to the container independently of the capsule, including the steps of placing over exposed portions of the closure and the portions of the neck adjacent said closure an impact extrusion of substantially pure aluminum and having a top and a depending side wall, and deforming the entirety of said side wall into close contact with laterally facing portions of the closure and adjacent portions of the neck, thereby to provide a tamper-evident cover for the closure.

6. A method of applying a tamper-evident capsule to a container equipped with a closure and having an annular external bead extending about the neck of the container, said closure having at least a portion thereof disposed externally of the mouth of the container, comprising the steps of placing over the closure and the portions of the neck adjacent the closure, including said bead, an impact extrusion of substantially pure aluminum and having a top and a depending side wall, and deforming the entirety of the side wall into close engagement with the closure and said portions of the neck including said hand, thereby to provide said capsule.

7. A capsule blank for application about the neck portion of a container and to cover at least part of the top surface of a sealing closure secured to the neck of the container independently of the capsule and thereby to form a tamper-evident cover for the closure, which capsule blank comprises an impact extrusion of inverted cup-shape made from substantially pure aluminum and having a top and a depending skirt which is capable of being cripmed inwardly into close contact with said neck portion, the skirt having two circumferentially-extending lines of weakening and the part of the skirt between said two lines being formed with a tab which can be pulled to tear said part along the lines of weakening.

8. A capsule blank as claimed in claim 7, characterised in that the top of the blank is thicker than the skirt.

9. A capsule blank as claimed in claim 7, characterised in that the top wall of the blank has a thickness in the range 0.88 to 1.78 mm.

10. A capsule blank as claimed in 7 characterised in that the skirt of the blank has a thickness of about 0.18 mm.

11. A capsule blank as claimed in claim 7 characterised in that the skirt of the blank has an increasing diameter in a direction away from the top.

12. A capsule blank as claimed in claim 7 characterised in that the skirt of the blank has a portion remote from the top of the blank which portion has a greater diameter than the portions of the skirt adjoining the top, a step being formed at the junction between the two said portions.

* * * * *